United States Patent [19]

Wilsberg et al.

[11] Patent Number: 4,931,063

[45] Date of Patent: Jun. 5, 1990

[54] PROCESS FOR THE PRETREATMENT OF SOILED FABRICS

[75] Inventors: Heinz-Manfred Wilsberg, Cologne; Georg Bosserhoff, Langenfeld; Rolf Puchta, Haan; Herbert Bücheler, Erkrath, all of Fed. Rep. of Germany

[73] Assignee: Henkel Kommanditgesellschaft auf Aktien, Duesseldorf, Fed. Rep. of Germany

[21] Appl. No.: 328,751

[22] Filed: Mar. 23, 1989

Related U.S. Application Data

[63] Continuation of Ser. No. 47,744, May 8, 1987, abandoned.

[30] Foreign Application Priority Data

May 9, 1986 [DE] Fed. Rep. of Germany ..... 3615544

[51] Int. Cl.[5] ..... D06M 1/00; A47L 11/00

[52] U.S. Cl. ..... 8/137; 8/137.5; 252/108; 252/174.21; 252/548; 252/550; 252/559; 252/DIG. 19; 252/DIG. 14; 252/547; 15/40; 15/106; 15/117

[58] Field of Search ..... 8/137, 137.5; 252/108, 252/155, 174.21, 549, 548, 550, 551, 554, 559, DIG. 14, DIG. 19, 90, 102; 15/40, 106, 117

[56] References Cited

U.S. PATENT DOCUMENTS

| | | | |
|---|---|---|---|
| 4,368,147 | 1/1983 | Inamorato et al. | 252/551 |
| 4,610,799 | 9/1986 | Wilsberg et al. | 252/90 |

FOREIGN PATENT DOCUMENTS

| | | |
|---|---|---|
| 0000235 | 1/1979 | European Pat. Off. . |
| 0109664 | 11/1983 | European Pat. Off. . |
| 2744642 | 4/1978 | Fed. Rep. of Germany . |
| 2857153 | 1/1980 | Fed. Rep. of Germany . |
| 2857157 | 3/1980 | Fed. Rep. of Germany . |
| 0160254 | 4/1985 | Fed. Rep. of Germany . |
| 0164703 | 6/1985 | Fed. Rep. of Germany . |
| 8522059 | 7/1985 | Fed. Rep. of Germany . |
| 3415880 | 10/1985 | Fed. Rep. of Germany . |

*Primary Examiner*—Paul Lieberman
*Assistant Examiner*—John F. McNally
*Attorney, Agent, or Firm*—Ernest G. Szoke; Wayne C. Jaeschke; Real J. Grandmaison

[57] ABSTRACT

Heavily soiled fabrics are pretreated before the actual washing process by applying a paste containing a mixture of a nonionic surfactant, at least one nitrogen containing compound selected from certain quaternary ammonium compounds, fatty amine ethoxylates and substituted aminocarboxylic acids, and also an antigel agent and a viscosity regulator to the fabrics and subsequently washing the fabrics in a wash liquor. In one preferred embodiment of the process, a distributing aid trimmed in particular with bristles is used to apply the paste.

5 Claims, No Drawings

PROCESS FOR THE PRETREATMENT OF SOILED FABRICS

This application is a continuation of application Ser. No. 07/047,744, filed 05/08/87 now abandoned.

BACKGROUND OF THE INVENTION

1. Field of the Invention

This invention relates to a process for the pretreatment of soiled fabrics. By the application of a paste containing active substances to the soiled fabrics and subsequent washing of the fabrics thus pretreated in a wash liquor, the cleaning of the fabrics is distinctly improved over non-pretreated fabrics.

2. Discussion of Related Art

In the washing of fabrics, a wash liquor is generally heated to an elevated temperature compared with room temperature. This measure enhances the detergency of the detergents used, in some cases to a considerable extend. However, the heating of the wash liquor and of the fabrics involves a high consumption of energy during the washing process. Since, in addition, many fabrics, particularly fabrics of wool or synthetic fibers, cannot be washed at elevated temperature for various reasons, attempts have repeatedly been made to obtain good washing results at low washing temperatures. In many cases, however, the effect of commercial detergents at low washing temperatures is reduced or even weakened to such an extent that the fabrics cannot be satisfactorily cleaned by washing. Through various measures, attempts have been made to improve detergency even at low washing temperatures. In one such effort to solve this problem, German patent application No. 27 44 642 describes a detergent additive which contains an organic bleach activator in water-releasable combination with a non-particulate substrate. A further improvement in the detergency of detergents is provided by an additive which, according to German patent application No. 28 57 153, contains in addition to a bleach activator a combination of an alkoxylated nonionic surfactant and a cationic surfactant with one radical containing from 8 to 20 carbon atoms and, for the rest, short chain radicals containing from 1 to 4 carbon atoms on a substrate. However, one disadvantage of this additive is that, on removing the additive from its pack and adding it to the detergent solution, the user comes into contact with the active substances which, apart from an occasionally unpleasant feeling, can lead to skin irritation. Another disadvantage of the additive in question is that, after washing, the water-insoluble substrate has to be recovered from the washed fabrics. To avoid the above-mentioned disadvantages, German patent application No. 34 15 880 describes a washing additive consisting of a mixture of several detergent ingredients accommodated in a bag based on polyvinylalcohol which is soluble in detergent solutions. The mixture of several detergent ingredients accommodated in a bag according to the teaching of this patent application is in the form of a paste which is adjusted by the addition thereto of an antigel agent and certain viscosity regulators to such a viscosity that it dissolves quickly and completely in the still cold detergent solution. Another solution to the above-mentioned problems is described in German patent application No. 28 57 157. According to the teaching of this patent application, the detergents contain certain nonionic and certain cationic surface-active compounds in a certain ratio to one another. The described preparations may be formulated as pastes and may also be used for the pretreatment of soiled fabrics. However, the patent application in question does not suggest what particular measures have to be taken in regard to the composition of pastes that are readily soluble in cold wash liquors, or that the application of pastes having a certain composition to soiled pieces of fabrics leads to particularly good washing results.

DESCRIPTION OF THE INVENTION

Other than in the operating examples, or where otherwise indicated, all numbers expressing quantities of ingredients or reaction conditions used herein are to be understood as modified in all instances by the term "about".

A process has now been found for the pretreatment of soiled fabrics with a paste-form preparation containing nonionic and cationic compounds which surprisingly leads to particularly good results. To carry out this process, a paste containing a mixture of at least one nonionic surfactant, at least one nitrogen-containing compound selected from the group consisting of a quaternary ammonium compound containing a long-chain $C_{10}$–$C_{20}$ alkyl or alkenyl radical and/or an adduct of from 1 to 6 moles of ethylene oxide with 1 mole of a primary fatty amine containing a long-chain $C_{10}$–$C_{16}$ alkyl or alkenyl radical and/or a compound of the formula R—NH—$CH_2$—$CH_2$—COONa, wherein R is an alkyl or alkenyl radical containing from 10 to 18 carbon atoms, more especially 14 carbon atoms, a polyhydric alcohol as an antigel agent and a viscosity regulator in such a quantity that the paste has a viscosity of from 1,000 to 100,000 mPas at a shear rate of from 5 to 500 $s^{31\ 1}$, is applied to the fabric and the fabric is then subjected to washing in a wash liquor. In some cases, it is best to use a paste which additionally contains an activator for per compounds. One such paste is known from the above-cited German patent application No. 34 15 880 as a washing additive which enhances the detergency of conventional detergents. The washing results obtained using the process according to the invention show a distinct improvement over the results obtained in accordance with German patent application No. 34 15 880 for the same quantities of paste.

In the context of the present invention, fabrics are understood to be articles of clothing of natural and/or synthetic fibers. In use, the articles of clothing pick up, inter alia, oily or greasy stains, bleachable stains or pigment soil which can be removed by washing in an aqueous wash liquor. The process according to the invention is effective against all these stains, but especially against cosmetic stains.

The nonionic surfactants of the paste suitable for the process according to the invention include, in particular, adducts of ethylene oxide with fatty alcohols or, more especially, oxoalcohols containing from 12 to 18 carbon atoms. Particularly suitable surfactants are those derived from $C_{14}$–$C_{15}$ alcohols. The best effects are obtained with oxoalcohol ethoxylates containing from 3 to 10, preferably from 6 to 8, and more especially about 7 moles of ethylene oxide per mole of alcohol. In many cases, it is best to add foam regulators. In many cases, foaming has to be suppressed. Suitable antifoam agents include, for example, the known silicone oils. The presence in the paste of nonionic surfactants above all enhances the removal of greasy or oily soil during washing.

The improvement in the removal of pigment soil from fabrics is brought about by the presence in the paste of certain nitrogen-containing compounds selected from the group consisting of quaternary ammonium compounds and/or ethylene oxide adducts of primary fatty amines and/or of β-amino-alkyl/alkenyl propionic acid salts corresponding to the formula $R—NH—CH_2—CH_2—COONa$. Suitable quaternary ammonium compounds are those which contain long-chain $C_{10}$–$C_{20}$ alkyl or alkenyl radicals and preferably alkyl groups containing from 10 to 16, and more especially about 14 carbon atoms. Suitable quaternary ammonium compounds include those which contain three identical or different $C_1$–$C_4$ alkyl groups. These short alkyl groups are in particular the methyl groups. One particularly suitable quaternary ammonium compound is tetradecyl trimethylammonium bromide. The quaternary ammonium compound may be completely or partly replaced by the fatty amine ethoxylate mentioned above. One example of a particularly suitable fatty amine ethoxylate is the adduct of 2 moles of ethylene oxide with primary cocosalkylamine.

Suitable activators for per compounds include N-acyl and O-acyl compounds. Particularly good results have been obtained with acetyl compounds such as, for example, tetraacetyl glycoluril, pentaacetyl glucose, and in particular, tetraacetyl ethylenediamine. in conjunction with the per compounds in typical heavy-duty detergent and more especially in conjunction with the perborate normally used, the bleach activators mentioned lead to improvement in the removal of bleachable fabric stains.

As antigel agent, the paste contains a polyhydric alcohol which is capable of preventing the known gelling of the nonionic surfactant on contact with water. Suitable antigel agents include, preferably, polyhydric alcohols containing from 2 to 4 carbon atoms which are thoroughly mixed with the nonionic surfactant. The antigel effect of the polyhydric alcohol may be enhanced by using a mixture of a polyhyric alcohol and a condensate of a $C_{10}$–$C_{20}$ fatty alcohol containing from 1 to 4 moles of ethylene oxide per mole of fatty alcohol instead of using the polyhydric alcohol alone. Polyhydric alcohols suitable as antigel agents include, for example, 1,2-propylene glycol, ethylene glycol, glycerol, or mixtures of these alcohols. An example of a particularly suitable fatty alcohol ethoxylate, which may be used in admixture with the polyhydric alcohol to enhace the antigel effect, is tallow alcohol ethoxylate containing 2 moles of ethylene oxide. However, a $C_{12}$–$C_{14}$ fatty alcohol ethoxylate containing 3 moles of ethylene oxide, of which approximately 70% consists of $C_{12}$ fatty alcohol ethoxylate, may also be used as an antigel agent. Where a polyhydric alcohol is exclusively used as the antigel agent, a good antigel effect is obtained if the ratio by weight of nonionic surfactant to polyhydric alcohol is from about 1:1 to 1:2. If, by contrast, a mixture of polyhydric alcohol and fatty alcohol ethoxylate is used, very good results are obtained if the ratio by weight of nonionic surfactant to polyhydric alcohol to fatty alcohol ethoxylate is in the range of 7–12 to 5–16 to 0.5–4. The antigel effect of the antigel agent may be enhanced by using readily water-soluble compounds, particularly sodium borate, sodium chloride, sodium sulfate, sodium acetate or even sugars, in addition to the antigel agents described above. A viscosity in the range of from 1,000 to 100,00 mPas is important for good dissolving behavior of the paste. To adjust the viscosity in that range, a number of different additives may be used as viscosity regulators, including for example water-insoluble zeolite, particularly of the zeolite A type; highly disperse silica; layer silicates, more especially swellable layer silicates of the bentonite and hectorite type; water-soluble salts, also sugars, polygycols or fatty alcohol ethoxylates containing a high percentage of ethylene oxide. A high percentage of ethylene oxide in the fatty alcohol ethoxylates means that the fatty alcohol ethyoxylate contains approximately 15 to 25 moles of ethylene oxide per mole of fatty alcohol.

For complexing troublesome heavy metal ions, the paste most preferably contains small quantities of a chelating agent. Particularly suitable chelating agents include water-soluble salts of alkane polyphosphonic acids selected from the group consisting of phosphonoalkane polycarboxylic acids and amino and hydroxy-substituted alkane polyphosphonic acids. More especially, the alkali metal salts of amino-tris-(methylene-phosphonic acid), dimethylene aminomethane diphosphonic acid, 1-hydroxyethyl-1,1-diphosphonic acid, 1-phosphonoethane-1,2-dicarboxylic acid, 2-phosphonobutane-1, 2,3-tricarboxylic acid and, in particular, the hexasodium salt of ethylene diaminotetramethylene phosphonic acid.

Suitable pastes contain highly viscous to paste-like mixtures of the following active substances:

2 to 30 parts by weight of a nonionic surfactant,
0.5 to 10 parts by weight of a nitrogen-containing compound,
2 to 30 parts by weight of an activator for per compounds, and
0 to 5 parts by weight of a heavy metal complexing agent.

The pastes may also contain:

2 to 50 parts by weight of an antigel agent,
5 to 20 parts of a viscosity regulator, and the remainder, foam regulators, and dyes in small quantities.

Providing mixtures such as these have the viscosity values mentioned above, they are called pastes even when they may be interpreted as being highly viscous liquids.

The pretreatment process according to this invention leads to particularly good results when the paste is applied to those parts of the fabrics to be washed which are stained or particularly heavily soiled, for example because they come into contact particularly frequently or intensively with soil. An application of from 2 to 50 g of active paste to a domestic washing machine load, approximately 2 to 5 kg of fabrics, is a quantity sufficient and also necessary for obtaining the desired cleaning effect. By "active paste" is meant the mixture of nonionic surfactant, nitrogen-containing compound, activator and, optionally, heavy metal complexing agent.

Although the paste may be applied more or less uniformly to the fabrics to obtain the desired effect, particularly good results are obtained when the paste is applied to the dry fabrics by spreading out to a thin layer thereon. Although the spreading may be performed by hand, it is best to use a spreading aid. A comb, a knife, or a toothed spatula, for example, are suitable spreading aids. However, it is best to use a spreading aid provided with bristles, i.e. for example, a pencil tipped with correspondingly stiff bristles or a brush. An aid provided with bristles surrounding the outlet opening of a tube containing the paste may be used with particular advantage for carrying out the process according to the invention. Such a tube is compressible and consists of one and the same material, for example an organic polymer or a metal, or of a composite material consisting of several different materials. The tube and the bristle-trimmed aid used to apply the paste may be integral or may consist of several parts. If the bristles of the aid taper towards their free end, i.e. towards the end remote from the tube, they are particularly suitable, particularly when the bristles have a triangular cross-section, for example a cross-section in the form of an equilateral triangle. Bristles having a length of from about 3 to about 30 mm have proven to be particularly suitable for uniform application of the paste. The size of the cross-sectional area of the bristles depends upon the density of the bristle trim. Aids trimmed with about 40 to about 100 bristles per $cm^2$, corresponding to a bristle cross-section of from about 1 to about 2 $mm^2$, as measured at that end of the bristles facing the tube, are particularly suitable for the process according to the invention. A tube with a spreading brush of the above-described type suitable for carrying the process according to the invention is known, for example, from German Utility Model Application No. 85 22 059.0. In many cases, it would appear to be best, when the tube is not in use, to cover and close the outlet opening thereof surrounded by the bristle-trimmed aid for spreading the paste by a cap.

The present invention also relates to a device for carrying out the process according to the invention. This device consists essentially of a tube containing a paste of the above-described type and composition and fitted with a bristle-trimmed spreading aid which surround the outlet opening of the tube.

In the following examples, it is shown how a pretreatment according to this invention affects the washing result. Test fabrics are artificially soiled using makeup (Fribad Cosmetics, natural) (=soil a) and mascara (Fribad Cosmetics, mascara) (=soil b). 3 g of the makeup and 2.5 g of the mascara are uniformly applied to polyester/cotton (50:50) fabrics. The soiling intensity was given a mark of 6 by five people skilled in the assessment of soils. Complete freedom from soil was given a mark of 1. Intermediate marks were on a scale graduated in mark units of 0.5.

In a test series I, the soiled test fabrics were then coated with 20, 30 and 40 g of a paste having the following composition:

18.4% by weight of a $C_{14}$–$C_{15}$ oxoalcohol containing 7 moles of ethylene oxide,
17.1% by weight of tetraacetyl ethylenediamine,
6.6% by weight of tetradecyl trimethylammonium bromide,
1.4% by weight of ethylenediamine tetramethylene phosphonate, hexasodium salt,
6.6% by weight of 1,2-propylene glycol,
6.6% by weight of glycerol,
1.8% by weight of oleyl/cetyl alcohol containing 2 moles of ethylene oxide,
9.9% by weight of Polywachs 4000,
11.9% by weight of Na acetate $+3\ H_{20}$, and
15.8% by weight of Na sulfate.

The paste was applied from a plastic tube which was approximately 140 mm long and from the welded closure to the neck of the tube and had a diameter based on a circular cross-section of approximately 45 mm. The outlet opening of the tube was circular with a diameter of approximately 5 mm. The tube opening was surrounded by a ring of plastic bristles having an external diameter of approximately 30 mm. The bristles were 15 mm long, tapered towards their free end and were spaced approximately 1 mm apart from one another. The cross-section of the bristles was that of an equilateral triangle. The tube had a volume of approximately 200 ml and was formed around its neck with a screwthread to receive a closure cap.

After storage for 1 day, the test fabrics thus pretreated were washed together with 3 kg of filler fabrics in an automatic domestic washing machine (Miele Deluxe W 433) with the addition of 228 g of a commercial heavy-duty detergent (corresponding to 4/5 of the prescribed dosage) and using the "coloreds" program (wash liquor temperature 60° C.). The washed and dried fabrics were then assessed for the remaining soiling intensity, three test fabrics being used for each assessment.

In another series of tests, test series II, test fabrics soiled in the same way were washed with the sole difference that the pretreatment paste was not applied to the test fabrics, but instead was added to the wash liquor. The washing results shown in Table I were obtained for test series I and II:

TABLE 1

| Test series I | Pretreated with g. of paste | | | |
|---|---|---|---|---|
| Soil | 0 | 20 | 30 | 40 |
| (a) | 2.5 | 1.0 | 1.0 | 1.0 |
| (b) | 2.8 | 1.5 | 1.5 | 1.5 |
| Test series II | Wash liquor containing g. of paste | | | |
| Soil | 0 | 20 | 30 | 40 |
| (a) | 2.5 | 1.6 | 1.5 | 1.3 |
| (b) | 3.1 | 2.2 | 1.9 | 1.9 |

Comparison of the washing results on the two test series clearly shows the better washing results obtained in test series I, although the same quantity of paste was able to act on the test fabrics as shown in test series II. This surprising result can only be attributed to the pretreatment process according to the invention.

We claim:

1. A process for the pretreatment of a soiled fabric comprising applying to a stained or heavily-soiled part of said fabric from about 2 to about 50 grams of a preparation to from about 2 to about 5 kilograms of said fabric by spreading said preparation in a thin layer on said fabric with a spreading aid trimmed with a plurality bristles, the singular bristle having a triangular cross-section, a length of from about 3 mm to about 30 mm, and a density of from about 40 to about 100 bristles per $cm^2$ corresponding to a bristle cross-section of from about 1 to about 2 $mm^2$, said spreading aid surrounding the outlet opening of a tube containing said preparation and being tapered toward the free end of said bristles, said preparation comprising (a) from about 2 to about 30 parts by weight of at least one nonionic surfactant which is an adduct of ethylene oxide with a fatty alcohol or an oxoalcohol wherein the fatty alcohol or oxoalcohol contains from 12 to 18 carbon atoms and the adduct contains from 3 to 10 moles of ethylene oxide per mole of alcohol, (b) from about 0.5 to about 10 parts by weight of at least one of:

(i) a quaternary ammonium compound a long-chain $C_{10}$–$C_{20}$ alkyl or alkenyl group and three $C_1$–$C_4$ alkyl groups, (ii) a fatty amine derivative which is an adduct of 1 to 6 moles of ethylene oxide with 1 mole of a primary fatty amine having a long-chain $C_{10}$–$C_{18}$ alkyl or alkenyl group, (iii) a compound of the formula R—NH—$CH_2$—$CH_2$—COONa where R is a $C_{10}$–$C_{18}$ alkyl or alkenyl group, (c) from about 2 to about 30 parts by weight of at least one activator for per compounds, (d) from about 2 to about 50 parts by weight of at least one polyhydric alcohol antigel agent, (e) from about 5 to about 20 parts by weight of at least one viscosity regulator in an amount sufficient to give the detergent composition a viscosity of from about 1000 to about 100,000 mPas, wherein the at least one viscosity regulator is selected from the group consisting of water insoluble zeolites, highly dispersed silica, layer-silicates, water-soluble salts, sugars, polyglycols, and fatty alcohol ethoxylates containing at least about 15 moles of ethylene oxide per mole of fatty alcohol, (f) from about 0 to 5 parts by weight of at least one heavy metal complexing agent, and, optionally, (g) a small quantity of a foam regulator, a dye, or both.

2. A process in accordance with claim 1 wherein said compound of said formula R—NH—$CH_2$—$CH_2$—COONa comprises a $\beta$-amino-propionic acid salt.

3. A process in accordance with claim 1 wherein said quaternary ammonium compound comprises tetradecyl trimethylammonium bromide.

4. A process in accordance with claim 1 wherein said activator for per compounds is selected from N-acyl and O-acyl compounds.

5. A process in accordance with claim 1 wherein said polyhydric alcohol antigel agent is selected from 1,2-propylene glycol, ethylene glycol, glycerol, or a mixture thereof.

* * * * *